United States Patent [19]

Niemi

[11] Patent Number: 4,481,078

[45] Date of Patent: Nov. 6, 1984

[54] PROCEDURE AND MEANS FOR CHANGING A PRESS FABRIC IN THE PRESS SECTION OF A PAPER MACHINE

[75] Inventor: Eero Niemi, Jyväskylä, Finland

[73] Assignee: Valmet Oy, Finland

[21] Appl. No.: 377,269

[22] PCT Filed: Sep. 22, 1981

[86] PCT No.: PCT/FI81/00073

§ 371 Date: May 6, 1982

§ 102(e) Date: May 6, 1982

[87] PCT Pub. No.: WO82/01202

PCT Pub. Date: Apr. 15, 1982

[30] Foreign Application Priority Data

Sep. 25, 1980 [FI] Finland ..... 803020

[51] Int. Cl.[3] ..... D21F 1/32; D21F 3/02; D21F 7/08

[52] U.S. Cl. ..... 162/199; 162/200; 162/274; 162/358

[58] Field of Search ..... 162/200, 273, 274, 358, 162/199

[56] References Cited

U.S. PATENT DOCUMENTS 2,367,778 1/1945 Hornbostel ..... 162/200
4,036,683 7/1977 Biondetti ..... 162/274

FOREIGN PATENT DOCUMENTS 2543780 3/1977 Fed. Rep. of Germany .
28569 1/1957 Finland .
57456 4/1980 Finland .
57988 7/1980 Finland .
74019506 2/1973 Sweden .

*Primary Examiner*—Steve Alvo
*Attorney, Agent, or Firm*—Steinberg & Raskin

[57] ABSTRACT

Method for changing a felt (20) in the press section of a paper machine. The normal run of said felt (20) passes in a substantial part in spaces (K) under the floor level (T—T) of the paper machine hall. In said press section its lower roll (12) is rotatably carried in support by one or several cantilevered beams (30). In the procedure the frame inserts (38) carrying one end of said cantilevered beam (30) are first removed and then lifting means (33,33') provided in conjunction with said cantilevered beam (30) is used to lift the guide roll or guide rolls (15,17) coming to lie within the loop of the felt to be changed and located in the underside space (K), into an upper position (15,15') to be adjacent to the cantilevered beam (30). After that the loop (50) of the new felt is spread out to the configuration implied by the rolls coming to lie therewithin, in which shape the felt loop (50) is pushed, using special equipment (40,41,42,43,44,45,46,47), to encircle the rolls (12,13,14,15 and 17) coming to lie inside the loop and around said cantilevered beam (30) through the space vacated by said removed inserts (38). Then the rolls (15',17') lifted into the upper position are lowered with their lifting means (33,33') into their operating position in the underside space (K), whereupon said frame inserts (38) are closed.

4 Claims, 4 Drawing Figures

PROCEDURE AND MEANS FOR CHANGING A PRESS FABRIC IN THE PRESS SECTION OF A PAPER MACHINE

BACKGROUND OF THE INVENTION

The present invention concerns, in the press section of a paper machine, in particular in a so-called closed-conduction press section, a procedure for changing such a felt of which the normal run passes to a substantial part in spaces below floor level, said press section having its lower roll and the potential guide rolls of the felt to be changed which are located adjacent thereto, rotatably carried by one or several cantilever beams.

Furthermore, the invention concerns a means intended for implementing the procedure of the invention and which is applied in connection with the press section, preferably a so-called closed conduction press section, of a paper machine, and said press section comprising a cantilevered beam, in connection of which have been rotatably carried the lower roll of the press and potential felt guide rolls in its vicinity, and one end of said cantilevered beam being supported by one or several inserts which can be taken out for the lower changing operation.

Recently, press fabrics made of synthetic plastic materials have come into common use in paper machine press sections, replacing the textile fabrics which were commonly used before. However, the introduction of these new fabric types has introduced problems associated with the changing of these fabrics. As known in the art, of course, textile fabrics were changed, e.g., so that the felt loop is stuffed in horizontal direction to become a kind of bundle and, starting to spread this out from one edge the felt loop is carried in through the gaps at the removed inserts, to be looped around those rolls which the felt loop will in its operation encircle and lap.

In so-called closed press sections, for instance the same applicant's Sym-Press II (Trademark) press section, the changing of synthetic fabrics involves immense problems. With a view to illustrating these problems, the structural design of said Sym-Press II press section shall now be described in its main features. It is well known that the Sym-Press II press section comprises at least three felts (press fabrics, in general): a first felt, e.g. a pick-up felt operating as press felt in the first and second nips of the press section, and a second felt operating as second press felt in the first nip, and this press section comprises a suction roll passed over by the first press felt, e.g. a pick-up felt. In conjunction with this suction roll two press nips are formed, of which the first press nip is two-felted, being defined by this roll together with a recessed surface press roll, and the second presents a single felt and is defined by said roll together with a smooth-surfaced roll, e.g. a stone roll. In conjunction of said stone roll or equivalent has further been provided the third press nip of the press section, which has its third felt (fabric loop). Changing of the upper felts in the Sym-Press press section and of other equivalent closed conduction upper felts, that is of those felts whose run is mainly located above the base floor level of the paper machine, is mainly possible to carry out with the aid of the overhead hoists or cranes in the paper machine hall. By the changing of the lower press felt in the Sym-Press press section has become a particularly refractory problem, i.e., that of the lower felt of the first two-felted nip. This is because said lower felt runs through the basement space of the paper machine hall, where it is not possible, at least not without expensive special arrangements, to use the overhead cranes of the paper machine hall.

SUMMARY OF THE INVENTION

Therefore, the object of the present invention is to provide a procedure, or means, applicable in connection with the Sym-Press press section or other equivalent press sections and whereby the fabrics, or fabric, of these press sections running a substantial part of its run in the basement space of the paper machine hall can be changed rather rapidly and using comparatively simple apparatus.

It is a special object of the invention: to provide a procedure and a means by which the fabrics mentioned may also be changed when they are such synthetic plastic fabrics which cannot be crammed to small bulk, or otherwise folded, in the transversal direction of the fabric loop.

In the prior art is known a procedure for changing a running felt, or felts, wherein the rolls in basement space which come to lie within the felt loop are raised with the aid of wires to be vertical and the new felt loop is introduced over these rolls in vertical position. However, this procedure of prior art is not applicable, at least not without difficulty, in the changing of those synthetic fabrics which must not be folded.

With a view to achieving the objects stated above, and others which will become apparent later on, the procedure of the invention is mainly characterized in that:

the insert in the frame support one end of said cantilevered beam is removed;

a lifting means provided in conjunction with said cantilevered beam, or a plurality of such means, is used to lift the guide roll, or guide rolls, intended to be within the felt that is being changed, in the down-below space, into an upper position adjacent to the cantilevered beam;

the loop of the new felt is spread to a configuration conforming to the rolls which will be located within this loop, special appliances being used to push the felt loop around the rolls to be placed within the loop and the said cantilevered beam through the free gap provided by said, removed inserts; and the roll/rolls lifted into upper position is/are lowered with the lifting means into the lower space, whereupon the said frame inserts are mounted to close the gaps.

The means of the invention is mainly characterized in that:

adjacent to said cantilevered beam, or inside it, has been provided one or several lifting means comprising wire reels which have been connected to drive means, and on said wire reels have been provided lifting wires for lifting the underside guide rolls operating within the felt loop, into an upper position in connection with said cantilevered beam.

The invention teaches to dispose the lifting means for the guide rolls of the fabrics of the press section which are located in basement space, in conjunction with the cantilevered frame beam of the press section. Hereby this even otherwise comparatively robust frame beam, or these beams, can be utilized to advantage, because it should be noted that in paper machines with great breadth the press fabrics' guide rolls have a comparatively great weight (their weight being e.g. 2000 to 3000 kg).

When performing change of press fabrics by the procedure of the invention, one may in certain steps also make use of the overhead crane in the paper machine hall. However, this crane may only be used to support the bracing tube of the fabric package that is being changed, in the space outside the frame interval of the paper machine, and in which connection no similar problems occur as are encountered if the overhead cranes of the paper machine hall were used for the lifting of the said heavy fabric guiding rolls in the basement space.

According to a favourable embodiment of the invention, the same means by which the guide rolls having their place within the lower felt loop are lifted into their upper position for felt changing, are also employed towards changing guide rolls in the basement space, to wit, even rolls which have their place outside the lower felt loop, and possibly other rolls. In such case, furthermore, that carriage means by which the tube bracing the felt loop that is being changed is displaced longitudinally, may also be used towards moving the guide rolls which are being changed. It is thus understood that by the lifting means of the invention the guide rolls to be changed may be lifted out from the basement space and transported, using the said carriage, to one side of the paper machine and the new roll can by using the same means be moved, first from the side of the paper machine into the paper machine and, thereafter, it may be lowered, using said means, into the basement space to its proper operating place.

BRIEF DESCRIPTION OF THE DRAWING

In the following, the invention is described in detail with reference being made to an embodiment example of the invention presented in the figures of the attached drawing, to the details of which the invention is not confined.

DETAILED DESCRIPTION OF PREFERRED EMBODIMENTS

Figure 1:
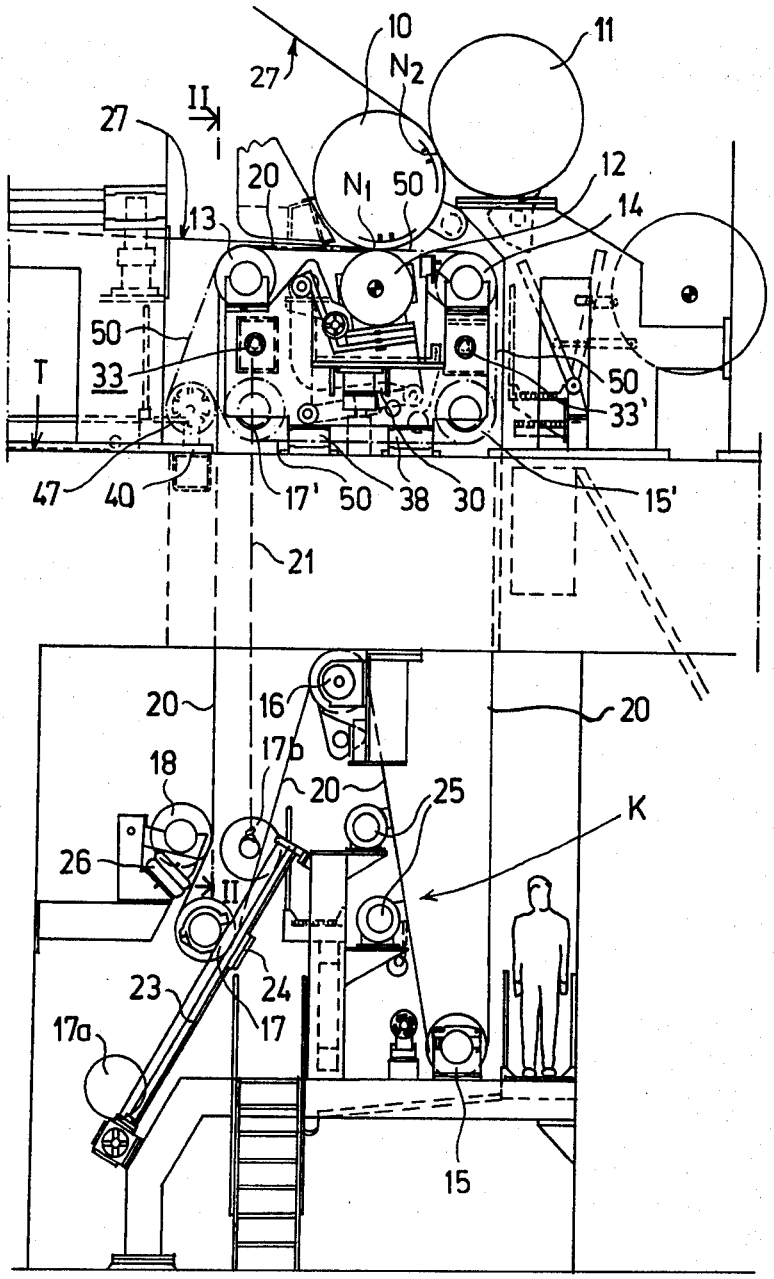
FIG. 1 presents in elevational view, the means applying the procedure of the invention, in connection with the ∓Sym-Press II" press section of a paper machine.
Figure 2:
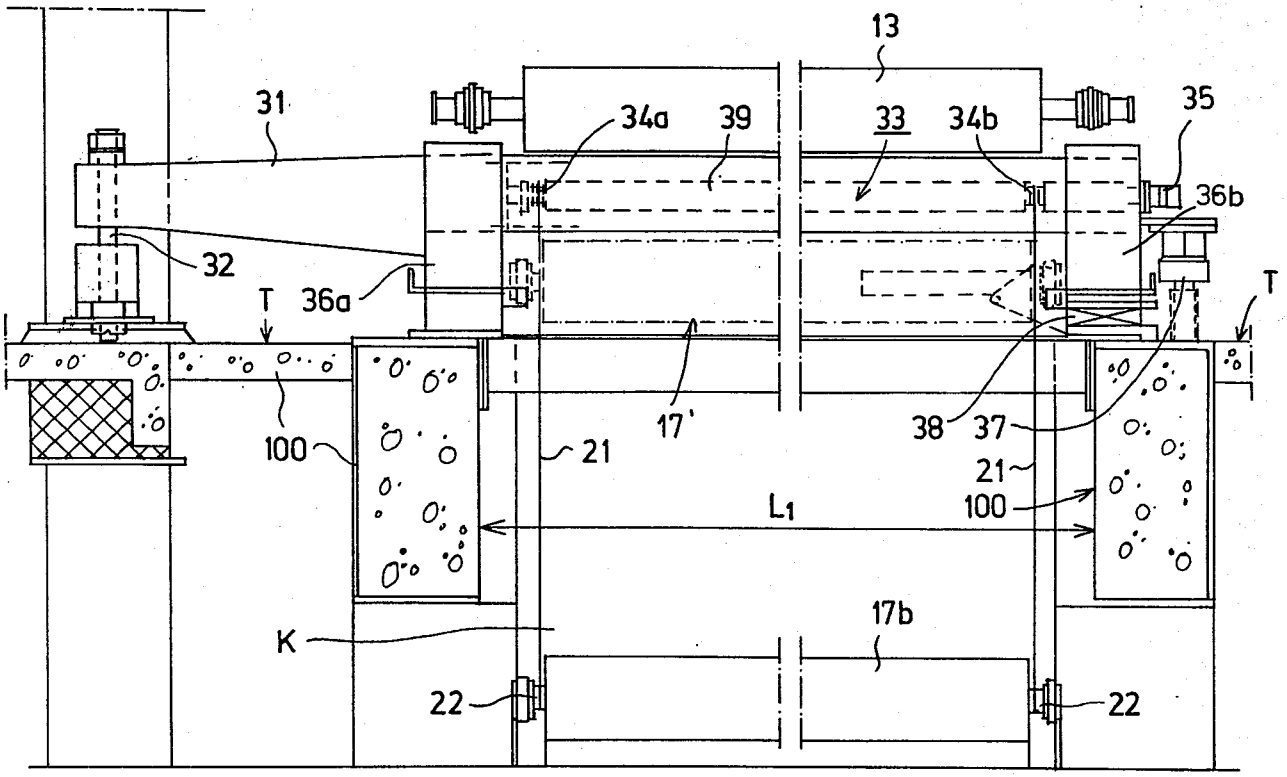
FIG. 2 shows the section II—II from FIG. 1.

FIGS. 1 and 2 show the so-called "Sym-Press II" (Trademark) press section only its underside members. This press comprises the suction roll 10, in connection of which the press nips $N_1$ and $N_2$ become defined. The first press nip $N_1$ is two-felted, being defined between the pick-up felt 27 and the lower felt 20. The lower felt runs under guidance by the guide rolls 13,14,15,16,17 and 18. The first felt 27 also operates as press felt in the second nip $N_2$. The lower roll 12 of the first nip $N_1$ is a recessed surface roll, e.g. a grooved roll. The third roll of the press section 11, is a smooth-surfaced roll, for instance a stone roll, and in its conjunction is defined the third nip (not depicted) of the press section, which has also been provided with a felt of its own (not depicted).

In the foregoing, in association with the fabrics 20 and 27, the talk has been of "felts", and it has now to be understood that "felt" has been used as general application covering all and any kinds of fabric and, in particular, also synthetic plastic fabrics, which—as observed before—cannot be folded or otherwise "wrinkled".

The present invention comprises a procedure and a means by which in a press section as described, or in other equivalent press sections, the lower felt 20, to wit, a felt running in basement or equivalent spaces, can be changed. As FIG. 1 reveals, the lower felt 20 runs in the basement space K under the floor level T—T of the paper machine hall, where it is not possible without difficulties to operate with the overhead cranes of the paper machine hall. The felt 20, which is for instance a felt of synthetic plastic, runs after the press nip $N_1$ onto the guide roll 14 and thence downward to the guide roll 15. After the guide roll 15, the felt 20 has been conducted to the roll 16, which is external to the felt loop. On the felt run 20 between rolls 15 and 16, felt reconditioning means 25 known in themselves in the art have been provided. From the roll 16, the felt 20 has been conducted to the guide roll 17, which has been mounted on the slide 24. It is possible by displacing the slide 24 on its guides 23, to carry out the basic tension adjustment of the felt loop 20. Reference numeral **17*a* indicate the lowermost extreme position of the guide roll 17. Following after the roll 17 on the path of the felt 20 has been provided a guide roll 18, which can be used in a manner known in itself in the art, with the aid of bellows means 26 or equivalent, towards fine adjustment of the tension of felt 20. After the roll 18, the run of the felt loop 20 is upwardly directed all the way up to the guide roll 13**.

The following is a description, with particular reference to FIG. 2, of the frame structure of the press section in such event as is necessary for the understanding of the present invention. The paper machine hall has foundations 100 known in themselves in the art, between which also is defined the basement space K, of which the breadth has been denoted with $L_1$. The lower roll 12 of the press section, the guide rolls 13 and 14 of the felt 20 and the lifting means 33 and 33' of the invention have been supported with the cantilevered beam 30. The beam 30 is carried on the foundation 100 by mediation of the side frames **36*a* and 36*b*. On the operator's side of the machine, to the beam 30 has been connected a cantilever part 31, which has been affixed to the foundation by the anchor 32. In connection with the side frame 36*b* of the beam 30 have been provided two inserts 38, which may be taken out by means of a pull-in carriage provided for the inserts 38—after the beam 30 and its side frame 36*b* have been slightly raised by means of the hydraulic cylinder 37. If there is a plurality of beams 30 side by side, each such beam will have its own cantilever part 31 and an anchor 32** in connection therewith.

Within the beam 30 have been disposed the lifting means 33 and 33' for the rolls 15 and 17 to be located in the basement space K within the felt loop 20. These means consist of a shaft 39 rotatably carried between the side frames **36*a* and 36*b* and carrying on both ends wire drums 34*a* and 34*b*. On the drums 34*a* and 34*b* have been wound wire ropes 21 or equivalent pulling members. The shafts 33 are driven by hydraulic motors 35 or equivalent. Moreover, for the change of the felt 20 there has been provided in the vicinity of one shaft 33 and thereinunder, a carriage 40 for driving the felt package 50 in. The carriage 40 moves on its wheels 41 along the track 42. In connection with the carriage 40, is mounted the bracing tube 43 for the felt package 50; this tube has on its end a handwheel 47** for the felt-spreading operation.

Although the talk was of one cantilevered beam 30 in the foregoing, the invention may equally be applied in press section designs having two or more separate cantilevered beams or other equivalent frame parts instead of the beam 30. It should further be noted that although in the foregoing in association with one beam 30 two separate lifting means 33 and 33' have been described; it should be understood that equally those problem solutions are within the scope of the invention in which one, two or even more lifting means are employed, depending on how many rolls located within the felt loop 20 need to be lifted into their upper position in connection with a felt change. It should be noted in this connection that one and the same lifting means may be used to lift into the upper position even more than one roll provided that the rolls have a small enough mutual horizontal distance. It is possible in that case to provide in connection with the frame beam 30 or equivalent, special supporting members on which the roll, that has been lifted up, is left to rest while another roll is being lifted into top position. In the embodiment depicted in the figures, the guide roll lifting members 21 at the same time operate as members supporting the rolls in their top position. As has been pointed out, this design is not the only lifting means design within the scope of the invention.

Figure 3:
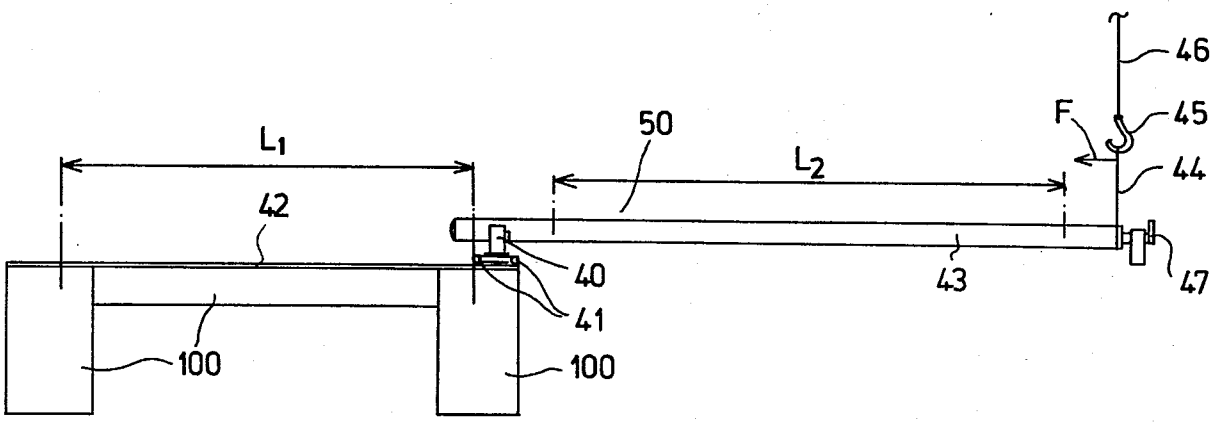
FIG. 3 illustrates the felt loop running-in phase, wherein a crane is used as aid.

In the following is described the changing of the felt 20, making use of the means just described. The old felt 20 is removed by cutting open the loop which it forms. Next, the new felt 50 wound around the bracing tube 43 is conveyed into the position shown in FIG. 3, where the bracing tube 43 is supported by means of the wire 44, with a hook 45 attached to the crane wire 46. The crane wire 46 has been attached e.g. to a crane operating under the ceiling of the paper machine hall (not depicted). The new felt 50 may be wound around the bracing tube 43 in such manner that the tube 43 comes to lie within or outside the felt loop 50. Care should be taken in this connection to see that the felt loop 50 is not folded too sharply. In the case that the bracing tube 43 comes to lie within the felt loop 50, the bracing tube must be moved to one side, and removed from within the felt loop 50, after the felt 50 has been slipped in.

To the purpose of felt changing, the rolls 17 and 15 have to be lifted to be close to the rolls 12,13 and 14. This is done with the lifting means 33,33' described above. As shown in FIGS. 1 and 2, the roll 17 has first been lifted on its slide 24 moving on the guides 23, into the upper position **17*b* and it has been separated from its bearing supports. In this position, the wires 21 are attached to the journal pins 22 of the roll 17 in position 17*b*. The roll 17 is thereafter lifted into the upper position 17', shown in FIGS. 1 and 2, between the frame structures 36*a* and 36*b*. In similar manner, the lifting means 33' are used to lift the roll 15 into its upper position 15'**.

After the said measures have been carried out, the new felt 50 wound upon the bracing tube 43 is spread out—by operating the crank 47—so that the felt loop assumes the position shown with dot-and-dash lines 50 in FIG. 1. The location of the felt package 50 in the breadth direction (cross-machine direction) at this stage has been indicated with reference $L_2$ in FIG. 3. The felt 50 is held in this position either by manpower or with special auxiliary means. The inserts 38 of the side frame **36*b* have been removed, the cantilevered frame beam 30 being held over its cantilever part 31 by the anchor 32 and, thus, by the foundation 100. The lifting wire 46 is now used to exert a pull in the direction of arrow F (FIG. 3), causing the carriage 40 to move on its wheels 41 on the track 42. At the same time the felt loop 50 is guided in over the rolls 12,13 and 14 with the nip $N_1$ opened. In this way the felt loop 50 can be transposed into its correct position around the rolls 12,13,14,15,17 and the frame beam 30, whereafter the hand crank 47 is operated to unwind more of the felt loop from its bracing tube 43. At the same time the rolls 15' and 17' may be lowered in their supports 21 into the bearing supports on the slide 24 and into the respective bearing supports of roll 15. The new felt 50 may then be tensioned in the place of the felt 20. If it is not possible to support the bracing tube 43 from above with the crane wire 46**, one may arrange for it a suitable support from below, and a work means and/or equivalent pulling means.

Figure 4:
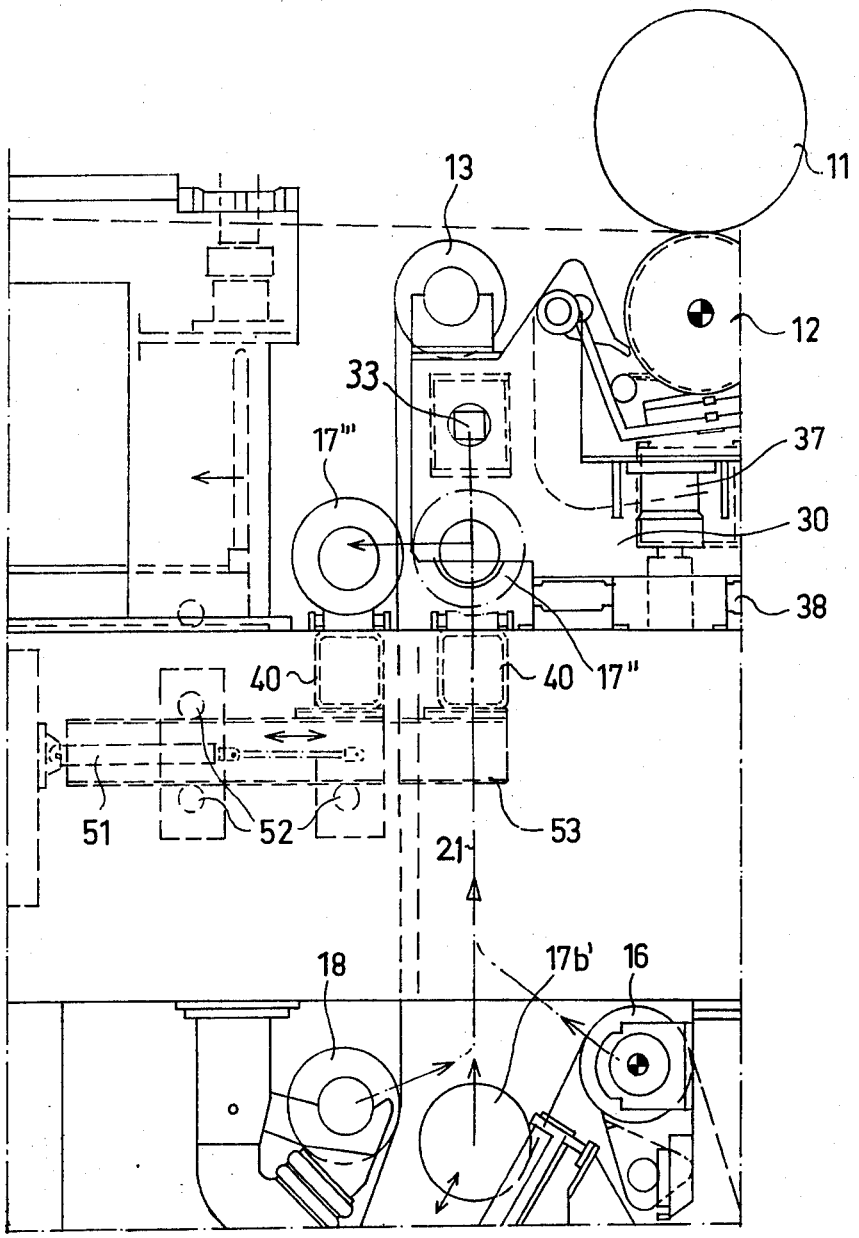
FIG. 4 presents schematically the use of the means of the invention in the changing of various guide rolls in the basement.

In the following shall be described, referring now to FIG. 4, the use of the means of the invention in the changing of guide rolls 15,16,17,18 and other equivalent apparatus located in the basement, which operation has previously presented problems. As shown in FIG. 4, the wires 21 of the lifting means 33 are attached to the journal pins of the roll to be changed, **17*b'*, and this roll is lifted into the upper position 17''. Next, the carriage 40 which has been provided to be displaceable on the beams 53, supported by the guides 52, under effect of the hydraulic cylinder 51, is moved into its position under the roll 17'', indicated with dot-and-dash lines. The wires 21 may now be loosened so that the roll 17'' settles to be carried by the carriage 40. The carriage 40 is then with the hydraulic cylinders 41 pulled into the position in which the roll assumes the location indicated with 17'''. In this position the roll 17''' may be pulled to one side of the paper machine and a new roll may be brought and installed, repeating the steps just described, in inverted order. It is likewise possible, in the manner described, to lift out from the basement space the rolls 15,16 and 18 and other rolls or pieces of apparatus to the lifting of which the lifting means 33,33'** are particularly well suited.

In the following are presented the claims, different details of the invention being allowed to vary within the scope of the inventive idea thereby defined.

I claim:

1. Method for changing a felt which forms a part of a press section of a paper machine, said press section including a felt having a run which passes above and below a certain level of said machine, over a lower press roll above said certain level, and over at least one first guide roll substantially adjacent to said lower press roll, said lower press roll and said at least one first guide roll being rotatably supported by at least one cantilever beam, said cantilever beam supported by at least one insert, wherein said insert is removed during the felt changing operation, the improvement comprising the steps of lifting both ends of at least one second guide roll disposed below said certain level, to an upper position substantially adjacent to said at least one cantilever beam, maintaining said lower press roll substantially in position when said at least one second guide roll is lifted, inserting a new felt around said lower press roll and around said first and second guide rolls through a space created by removing said at least one insert, lowering said at least one second guide roll to its original position, and re-introducing said at least one insert.

2. The method of claim 1 in which the new felt is inserted by the steps of disposing said new felt in a wound configuration on elongated bracing means supported on one end by at least one hoisting wire and on the other end on said machine through carriage means adapted to slide in a direction transverse to the running direction of the felt, with said at least one second guide roll in raised position, spreading said new felt to fit around all said respective rolls, and sliding said carriage means in the direction transverse to the running direction of said felt.

3. The method of claim 1 in which said press section of said paper machine comprises a plurality of nips, a first nip formed between said lower press roll and a suction roll, and a second nip formed between said suction roll and a smooth surfaced roll, and a second felt running through said first and second nips.

4. The method of claim 1 which comprises the additional step of removing said at least one second guide roll and lowering a new second guide roll in its place.

* * * * *